US005189007A

United States Patent [19]

Aihara et al.

[11] Patent Number: 5,189,007

[45] Date of Patent: Feb. 23, 1993

[54] THERMOSENSITIVE RECORDING MATERIAL

[75] Inventors: Hideo Aihara, Numazu; Norio Kurisu, Susono; Kazuhiro Takei, Numazu; Yasuhiko Watanabe, Shizuoka, all of Japan

[73] Assignee: Ricoh Company, Ltd., Tokyo, Japan

[21] Appl. No.: 805,621

[22] Filed: Dec. 12, 1991

[30] Foreign Application Priority Data

Dec. 17, 1990 [JP] Japan ..... 2-411120

[51] Int. Cl.[5] ..... B41M 5/40

[52] U.S. Cl. ..... 503/207; 503/200; 503/226

[58] Field of Search ..... 503/200, 207, 226

[56] References Cited

FOREIGN PATENT DOCUMENTS 0171810 2/1986 European Pat. Off. .
0179492 4/1986 European Pat. Off. .
0344705 12/1989 European Pat. Off. .
WO8906191 7/1989 PCT Int'l Appl. .
2178183 2/1987 United Kingdom .

OTHER PUBLICATIONS

Japanese Patent Abstract 58-208091 Dec. 3, 1983.
Japanese Patent Abstract 62-59081 Mar. 14, 1987.

*Primary Examiner*—Pamela R. Schwartz
*Attorney, Agent, or Firm*—Oblon, Spivak, McClelland, Maier & Neustadt

[57] ABSTRACT

A thermosensitive recording material is composed of a support, a thermosensitive coloring layer capable of inducing color formation upon application of heat thereto, formed on the support, and a protective layer including a resin and a filler formed on the thermosensitive coloring layer, the filler containing aluminum hydroxide or/and aluminum oxide particles, having a volume mean diameter of 1 μm or less, with the amount of the particles with a diameter of 4 μm or less being 90 vol. % or more in the entire particles.

10 Claims, No Drawings

THERMOSENSITIVE RECORDING MATERIAL

BACKGROUND OF THE INVENTION

1. Field of the Invention

This invention relates to a thermosensitive recording material, and more particularly to a thermosensitive recording material comprising a thermosensitive coloring layer and a protective layer successively formed on a support, which protective layer comprises a resin and a filler comprising aluminum hydroxide or/and aluminum oxide particles, having a volume mean diameter of 1 μm or less, with the amount of the particles with a diameter of 4 μm or less being 90 vol. % or more in the entire particles.

2. Discussion of Background

Conventionally, there is known a thermosensitive recording material, in which a thermosensitive coloring layer mainly comprising a thermosensitive coloring composition is provided on a support such as a sheet of paper or synthetic paper, or a plastic film. In such a recording material colored images are obtained by application of heat to the recording material using a thermal printer provided with a thermal head.

This type of thermosensitive recording material is widely used, not only as a recording material for copying books and documents, but also as a recording material for use with computers, facsimile apparatus, teleprinter exchanger, medical instruments, measuring instruments, ticket vendors, and label printing machines for the POS system in supermarkets and department stores, because of the following advantages over other conventional recording materials:

(1) images can be speedily recorded by using a comparatively simple device without complicated steps such as development and image fixing;

(2) images can be recorded without generating noise; and (3) the manufacturing cost is low.

When such a thermosensitive recording material is used as a thermosensitive adhesive label for the POS system of supermarkets and department stores, characters and bar codes representing the product name and price are thermally recorded on the thermosensitive adhesive label using a thermal printer provided with a thermal head, and the thermally printed label is applied to a variety of commercial products, with the backing sheet of the label removed therefrom. Thus, customers can identify the name and price of the product and other information concerning the product by the label. Furthermore, the bar codes thermally printed on the thermosensitive adhesive label can be read by an automatic bar code reader at the point of registration and the bar code information is processed by computer, which promotes the sales management and stock control, and thus facilitates the reorder of products.

When such thermosensitive recording adhesive labels are employed, particularly in food packaging, it is required that thermally printed images on the labels be prevented from becoming blurred or fading away even if they are brought into contact with oils contained in foods and plasticizers contained in a plastic wrapping film.

In order to satisfy the above requirements, various proposals have been made. For example, in Japanese Patent Publication No. 58-39078, a protective layer comprising a resin such as polyvinyl alcohol and a filler is formed on a thermosensitive coloring layer, thereby preventing the thermosensitive coloring layer from coming into contact with the oil and the plasticizer. However, when such a protective layer comprising the resin as the main component is overlaid on the thermosensitive coloring layer, the resin is fused and adheres to the surface of a thermal head while the thermal recording is carried out under application of thermal energy from the thermal head. Thus, a so-called "head-dust" gradually accumulates on the thermal head and the sticking of the recording material to the thermal head occurs.

In order to solve the above problems, various organic and inorganic fillers to be employed in the protective layer have been studied. For example, Japanese Laid-Open Patent Application No. 58-208091 discloses a protective layer comprising as a filler silicon dioxide; and Japanese Laid-Open Patent Application No. 62-59081, aluminum hydroxide.

When the protective layers comprising the above-mentioned fillers are employed, however, all the requirements cannot be satisfied in practice. More specifically, in the case where the head-dust problem and the sticking problem are solved in some degree, the thermal head is worn out. When the thermal head is prevented from wearing, the head-dust problem occurs. The conventional fillers cannot satisfactorily serve to solve both the head-dust problem and the head-wearing problem at the same time.

SUMMARY OF THE INVENTION

Accordingly, an object of the present invention is to provide a thermosensitive recording material which has an excellent head-matching property, in particular, a thermosensitive recording material which does not cause the head-dust problem, the sticking problem or the head wearing problem.

The object of the present invention can be attained by a thermosensitive recording material comprising: (a) a support, (b) a thermosensitive coloring layer, formed on the support, which induces color formation upon application of heat thereto, and (c) a protective layer comprising a resin and a filler formed on the thermosensitive coloring layer, which comprises at least one component selected from the group consisting of aluminum hydroxide and aluminum oxide particles, having a volume mean diameter of 1 μm or less, with the amount of the particles with a diameter of 4 μm or less being 90 vol. % or more in the entire particles.

DESCRIPTION OF THE PREFERRED EMBODIMENTS

According to the present invention, since the volume mean diameter of the particles of the filler for use in the protective layer of the thermosensitive recording material is 1 μm or less and the amount of the particles of the filler with a diameter of 4 μm or less is 90 vol. % or more in the entire particles (measured with Microtrac particle size analyzer Model 7991-3, made by Leeds and Northrup Co., Ltd.), the wear of the thermal head can be decreased. In addition, the head-dust problem and the sticking problem can be remarkably improved because the filler comprises the finely-divided particles of aluminum hydroxide or/and aluminum oxide.

The above-mentioned aluminum hydroxide, which has been used as a filler in the conventional thermosensitive recording materials, can be employed in the protective layer of the thermosensitive recording material according to the present invention.

As the aluminum oxide to be employed as a filler in the protective layer, not only conventionally used α-alumina, but also various kinds of intermediate aluminas obtained during the calcination of aluminum hydroxide, can be used. A colloidal alumina with a particle diameter of 0.1 μm or less can also be employed.

It is preferable that the amount ratio of the above-mentioned filler to the entire solid components in the protective layer be 5 to 90 wt. %, more preferably 10 to 50 wt. %.

When necessary, other fillers can be employed with the above aluminum compounds. Specific examples of the filler usable with the aluminum compounds are calcium carbonate, barium sulfate, talc, agalmatolite, kaolin, calcined kaolin, zinc oxide, diatomite, crystalline silica, amorphous silica, lithopone, titanium oxide, urea—formaldehyde resin and polyethylene.

In the present invention, the protective layer in the thermosensitive recording material comprises a resin and a filler as the main components. As the resin, gelatin, starch, hydroxyethylcellulose, polyacrylic acid, carboxyethylcellulose, methoxycellulose, polyvinyl alcohol and modified compounds of the above materials, and polyvinyl pyrrolidone can be employed.

In addition to the above-mentioned resin and filler, when necessary, a conventionally used crosslinking agent (curing agent), a lubricant, a wax and a surface active agent can be used in the protective layer of the thermosensitive recording material according to the present invention.

Specific examples of the crosslinking agent (the curing agent) are polyepichlorohydrin, glyoxal, glutaric aldehyde, melamine compounds, polyamide—polyurea resin, aziridine compounds, zirconium compounds and boric acid.

As the lubricant, metal salts of higher fatty acids such as aluminum stearate and calcium stearate can be preferably employed.

Specific examples of the wax are polyethylene wax, paraffin wax, microcrystalline wax and carnauba wax.

In the thermosensitive recording material of the present invention, the thermosensitive coloring layer comprises a leuco dye and a color developer capable of inducing color formation in the leuco dye upon application of heat thereto.

In the present invention, as the leuco dye for use in the thermosensitive coloring layer, which can be used alone or in combination, any conventional leuco dyes for use in conventional thermosensitive recording materials can be employed. For example, triphenylmethane-type leuco compounds, fluoran-type leuco compounds, phenothiazine-type leuco compounds, auramine-type leuco compounds, spiropyran-type leuco compounds, and indolinophtalide-type leuco compounds are preferably employed. Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-di-n-butylaminophenyl)phthalide,
3-cyclohexylamino-6-chlorofluoran,
3-dimethylamino-5,7-dimethylfluoran,
3-N-methyl-N-isobutyl-6-methyl-7-anilinofluoran,
3-N-ethyl-N-isoamyl-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-ethyl-N-p-tolyl)-6-methyl-7-anilinofluoran,
3-(N-p-tolyl-N-ethylamino)-6-methyl-7-anilinofluoran,
3-pyrrolidino-6-methyl-7-anilinofluoran,
2-anilino-3-methyl-6-diethylaminofluoran,
2-[N-[3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-di-n-butylamino-7-(o-chloroanilino)fluoran,
3-N-methyl-N,n-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)-fluoran,
3-(N,N-diethylamino)-5-methyl-7-{N,N-dibenzylamino)fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5' -nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)-fluoran,
3-pyrrolidino-7-m-trifluoromethylanilinofluoran,
3-diethylamino-5-chloro-7-(N-benzyl-trifluoromethylanilino)-fluoran,
3-pyrrolidino-7-(di-p-chlorophenyl)methylamino-fluoran,
3-diethylamino-5-chloro-7-(α-phenylethylamino)-fluoran,
3-diethylamlno-6-methyl-7-xylidinofluoran,
6-(N-isoamyl-N-ethylamino)-7,8-benzfluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)-fluoran,
3-diethylamino-7-piperidinofluoran,
2-chloro-3-(N-methyltoluidino)-7-(p-n-butylanilino)-fluoran,
3-(N-methyl-N-isopropylamino)-6-methyl-7-anilino-fluoran,
3-di-n-butylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran, 3-N-ethyl-N-tetrahydrofurfurylamino-6-methyl-7-anilinofluoran, and 3-diethylamino-6-methyl-7-mesidino-4',5'-benzofluoran.

As the color developers for use in the thermosensitive coloring layer in the present invention, various electron acceptors which work upon the above-mentioned leuco dyes to induce color formation, such as phenolic compounds, thiophenolic compounds, thiourea derivatives, organic acids and metal salts thereof, are preferably employed.

Specific examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl)-butane,
4,4'-thiobis(6-tert-butyl-2-methylphenol),
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoate,
2-hydroxy-1-naphthoate,
1-hydroxy-2-naphthoate,
zinc hydroxynaphthoate,
aluminum hydroxynaphthoate,
calcium hydroxynaphthoate,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
3,4-dihydroxy-4'-methyldiphenylsulfone,
3,3'-diallyl-4,4'-diphenolsulfone,
α,α-bis(4-hydroxyphenyl)-α-methyltoluene,
antipyrine complex of zinc thiocyanate,
tetrabromobisphenol A, and
tetrabromobisphenol S.

A variety of conventional binder agents can be employed for binding the leuco dye and the color developer to the support of the thermosensitive recording material of the present invention.

Specific examples of the binder agents are as follows: polyvinyl alcohol; starch and starch derivatives; cellulose derivatives such as hydroxymethylcellulose, hydroxyethylcellulose, carboxymethylcellulose, methylcellulose, and ethylcellulose; water-soluble polymers such as sodium polyacrylate, polyvinyl pyrrolidone, acrylamide—acrylic acid ester copolymer, acrylamide—acrylic acid ester—methacrylic acid terpolymer, alkali salts of styrene—maleic anhydride copolymer, alkali salts of isobutylene—maleic anhydride copolymer, polyacrylamide, sodium alginate, gelatin, and casein; emulsions such as polyvinyl acetate, polyurethane, polyacrylic acid ester, polymethacrylic acid ester, vinyl chloride—vinyl acetate copolymer, and ethylene—vinyl acetate copolymer; and latexes such as styrene—butadiene copolymer and styrene—butadiene—acrylic acid derivative copolymer.

Moreover, when necessary, the auxiliary additive components which are used in the conventional thermosensitive recording materials, such as a filler, a surface active agent, a thermofusible material (or a lubricant) and an agent for preventing color formation by pressure application can be employed with the above-mentioned leuco dye and the color developer in the thermosensitive coloring layer.

Examples of the filler include finely-divided particles of inorganic fillers such as calcium carbonate, silica, zinc oxide, titanium oxide, aluminum hydroxide, zinc hydroxide, barium sulfate, clay, talc, surface-treated calcium and surface-treated silica; and finely-divided particles of organic fillers such as urea—formaldehyde resin, styrene—methacrylic acid copolymer and polystyrene resin.

Examples of the thermofusible material are as follows: higher fatty acids and esters, amides, and metal salts thereof; and other thermofusible organic compounds with a melting point ranging from about 50° to 200° C., such as various kinds of waxes, condensates of aromatic carboxylic acids and amines, phenyl benzoate, higher straight-chain glycols, dialkyl 3,4-epoxy-hexahydrophthalate and higher ketones.

The thermosensitive recording material of the present invention comprises a support, a thermosensitive coloring layer formed on the support, and a protective layer formed on the thermosensitive coloring layer. When necessary, an intermediate layer can be provided between the support and the thermosensitive coloring layer in order to improve a thermosensitive coloring sensitivity. In addition, a plurality of protective layers of the same type as previously mentioned can be provided on the thermosensitive coloring layer, or the previously mentioned protective layer may be laminated with the protective layer comprising the conventionally used resin and filler.

Other features of this invention will become apparent in the course of the following description of exemplary embodiments, which are given for illustration of the invention and are not intended to be limiting thereof.

EXAMPLE 1

Formation of Thermosensitive Coloring Layer

A dispersion A and a dispersion B were separately prepared by pulverizing and grinding the respective mixtures with the following formulations in a sand grinder so as to have an average particle diameter of about 2 μm in accordance with the Coulter counter method:

| | parts by weight |
|---|---|
| [Dispersion A] | |
| 2-anilino-3-methyl-6-diethylamino-fluoran | 20 |
| 2.5% aqueous solution of polyvinyl alcohol (Trademark "PVA117", made by Kuraray Co., Ltd.) | 80 |
| [Dispersion B] | |
| 2, 2'-bis(p-hydroxyphenyl)propane | 20 |
| Stearic acid amide | 20 |
| Hydrotalcite $[Mg_6Al_2(OH)_{16}][CO_3 \cdot 4H_2O]$ | 20 |
| 2% aqueous solution of polyvinyl alcohol | 240 |

One part by weight of dispersion A and 3 parts by weight of dispersion B were mixed and stirred to prepare a coating liquid for a thermosensitive coloring layer. The thus prepared coating liquid for the thermosensitive coloring layer was coated by a wire bar on a sheet of high quality paper with a basis weight of 50 g/m$^2$, in a deposition amount of approximately 5 g/m$^2$ on a dry basis, and then dried, so that a thermosensitive coloring layer was formed on the support.

Formation of Protective Layer

A mixture of the following components was dispersed in a sand grinder, so that a dispersion C of aluminum hydroxide particles with a volume mean diameter of 0.9 μm, with the amount of the particles with a diameter of 4 μm or less being 99 vol. % in the entire particles.

| [Dispersion C] | parts by weight |
|---|---|
| Aluminum hydroxide | 5 |
| 5% aqueous solution of polyvinyl alcohol (Trademark "PVA117", made by Kuraray Co., Ltd.) | 100 |

100 parts by weight of the thus prepared dispersion C, 1 part by weight of a 40% aqueous solution of glyoxal and 1 part by weight of a 30% dispersion of zinc stearate were mixed to prepare a coating liquid for a protective layer. The thus prepared coating liquid for the protective layer was coated by a wire bar on the previously formed thermosensitive coloring layer in a deposition amount of approximately 2.5 g/m$^2$ on a dry basis, and then dried, so that a protective layer was formed on the thermosensitive coloring layer. The thus formed protective layer was subjected to calendering, whereby a thermosensitive recording material of the present invention was obtained.

EXAMPLE 2 AND COMPARATIVE EXAMPLES 1 TO 3

The procedure for preparing the thermosensitive recording material in Example 1 was repeated except that the volume mean diameter and the amount of the particles with a diameter of 4 μm or less in the entire particles of aluminum hydroxide for use in the dispersion C were changed as shown in Table 1.

TABLE 1

| Example No. | Filler Used in Dispersion C | Volume Mean Diameter (μm) | Amount of Particles with Diameter of 4 μm or Less (vol. %) |
|---|---|---|---|
| Ex. 1 | Aluminum hydroxide | 0.9 | 99 |
| Ex. 2 | Aluminum hydroxide | 0.6 | 94 |
| Comp. Ex. 1 | Aluminum hydroxide | 1.3 | 93 |
| Comp. Ex. 2 | Aluminum hydroxide | 0.8 | 88 |
| Comp. Ex. 3 | Aluminum hydroxide | 1.6 | 83 |

EXAMPLE 3

The procedure for preparing the thermosensitive recording material in Example 1 was repeated except that the dispersion C of aluminum hydroxide particles with a volume mean diameter of 0.9 μm, with the amount of the particles with a diameter of 4 μm or less being 99 vol. % in the entire particles, was replaced by a dispersion D of aluminum oxide particles with a volume mean diameter of 0.8 μm, with the amount of the particles with a diameter of 4 μm or less being 99 vol. % in the entire particles.

Thus, a thermosensitive recording material of the present invention was obtained.

EXAMPLES 4 AND 5 AND COMPARATIVE EXAMPLES 4 AND 5

The procedure for preparing the thermosensitive recording material in Example 3 was repeated except that the volume mean diameter and the amount of the particles with a diameter of 4 μm or less in the entire particles of aluminum oxide for use in the dispersion D were changed as shown in Table 2.

TABLE 2

| Example No. | Filler Used in Dispersion D | Volume Mean Diameter (μm) | Amount of Particles with Diameter of 4 μm or Less (vol. %) |
|---|---|---|---|
| Ex. 3 | Aluminum oxide | 0.8 | 99 |
| Ex. 4 | Aluminum oxide | 0.4 | 99 |
| Ex. 5 | Aluminum oxide(*) | 0.05 | 100 |
| Comp. Ex. 4 | Aluminum oxide | 1.3 | 90 |
| Comp. Ex. 5 | Aluminum oxide | 1.6 | 85 |

(*) Aluminum oxide employed in Exmple 5 was a commercially available colloidal alumina (Trademark "Alumina sol-200", made by Nissan Chemical Industries, Ltd.). The colloidal alumina was mixed with a 5% aqueous solution of polyvinyl alcohol in such a manner that the same solid content as that of the other dispersions of aluminum oxide in Example 3 and 4 and Comparative Examples 4 and 5 was obtained.

COMPARATIVE EXAMPLE 6

The procedure for preparing the thermosensitive recording material in Example 1 was repeated except that the aluminum hydroxide particles for use in the dispersion C in Example 1 were replaced by finely-divided particles of silicon dioxide to prepare a dispersion E of silicon dioxide particles with a volume mean diameter of 0.9 μm, with the amount of the particles with a diameter of 4 μm or less being 98 vol. % in the entire particles.

Thus, a comparative thermosensitive recording material was obtained.

COMPARATIVE EXAMPLE 7

The procedure for preparing the thermosensitive recording material in Example 1 was repeated except that the aluminum hydroxide particles for use in the dispersion C in Example 1 were replaced by finely-divided particles of urea—formaldehyde resin to prepare a dispersion F of urea—formaldehyde resin particles with a volume mean diameter of 0.8 μm, with the amount of the particles with a diameter of 4 μm or less being 95 vol. % in the entire particles.

Thus, a comparative thermosensitive recording material was obtained.

Each of the thus obtained thermosensitive recording materials was loaded in a thermal printer having a thin film head (made by Matsushita Electronic Components Co., Ltd.), and subjected to a thermal printing test under the conditions that the applied electric power was 0.60W/dot and the pulse width was 1.2 msec. In the printing test, the adhesion of dust to the thermal head, the occurrence of the sticking problem and the wear of the thermal head were evaluated by the following methods.

(1) Adhesion of Dust to the Thermal Head

Images were thermally printed on each recording material with a length of 5 m under the above conditions.

The amount of the dust adhering to a resistance heating element of the thermal head was visually inspected and evaluated in accordance with the following scale:

○: Head-dust was scarcely observed.

Δ: Head-dust was slightly observed.

x: Head-dust was considerably observed.

(2) Occurrence of Sticking Problem

Images were thermally printed on each recording material with a length of 5 m under the same condition as in the above and the sticking of the thermosensitive recording material to the thermal head was estimated from the noise.

○: No sticking noise.

Δ: There was a slight noise.

x: The sticking noise was distinct.

(3) Wear of the Thermal Head

Images were thermally printed on each recording material with a length of 10 km under the same condition as in the above, and a surface of the thermal head was observed with a microscope and compared with the surface condition of the thermal head observed before the thermal printing test.

The wear of the thermal head was evaluated in accordance with the following scale:

○: Thermal head was not subjected to wear.

Δ: Thermal head was slightly subjected to wear.

x: Thermal head was subjected to wear.

The results are shown in Table 3.

TABLE 3

| Example No. | Adhesion of Dust to Head | Sticking Problem | Wear of Head |
|---|---|---|---|
| Ex. 1 | ○ | ○ | ○ |
| Ex. 2 | ○ | ○ | ○ |
| Ex. 3 | ○ | ○ | ○ |
| Ex. 4 | ○ | ○ | ○ |
| Ex. 5 | ○ | ○ | ○ |
| Comp. Ex. 1 | ○ | ○ | Δ |
| Comp. Ex. 2 | ○ | ○ | Δ |
| Comp. Ex. 3 | ○ | ○ | x |
| Comp. Ex. 4 | ○ | ○ | x |
| Comp. Ex. 5 | ○ | ○ | x |
| Comp. Ex. 6 | ○ | ○ | x |
| Comp. Ex. 7 | Δ | Δ | ○ |

It is obvious from Table 3 that the thermosensitive recording materials of the present invention do not cause the head-dust problem, sticking problem and head wearing problem.

What is claimed is:

1. A thermosensitive recording material comprising:
   a support,
   a thermosensitive coloring layer capable of inducing color formation upon application of heat thereto comprising a leuco dye and a color developer capable of inducing color formation in said leuco dye upon application of heat thereto, formed on said support, and
   a protective layer comprising a resin and a filler formed on said thermosensitive coloring layer, said filler comprising at least one component selected from the group consisting of aluminum hydroxide and aluminum oxide particles, having a volume mean diameter of 1 μm or less, with the amount of the particles with a diameter of 4 μm or less being 90 vol. % or more.

2. The thermosensitive recording material as claimed in claim 1, wherein said filler contained in said protective layer consists of aluminum hydroxide particles having a volume mean diameter of 1 μm or less, with the amount of the particles with a diameter of 4 μm or less being 90 vol. % or more.

3. The thermosensitive recording material as claimed in claim 1, wherein said filler contained in said protective layer consists of aluminum oxide particles having a volume mean diameter of 1 μm or less, with the amount of the particles with a diameter of 4 μm or less being 90 vol. % or more.

4. The thermosensitive recording material as claimed in claim 1, wherein said filler contained in said protective layer consists of a mixture of aluminum hydroxide particles and aluminum oxide particles having a volume mean diameter of 1 μm or less, with the amount of the particles with a diameter of 4 μm or less being 90 vol. % or more.

5. The thermosensitive recording material as claimed in claim 1, wherein the ratio of said filler to the entire solid components contained in said protective layer is 5 to 90,wt. %.

6. The thermosensitive recording material as claimed in claim 1, wherein said filler contained in said protective layer further comprises at least one component selected from the group consisting of calcium carbonate, barium sulfate, talc, agalmatolite, kaolin, calcined kaolin, zinc oxide, diatomite, crystalline silica, amorphous silica, lithopone, titanium oxide, urea—formaldehyde resin and polyethylene.

7. The thermosensitive recording material as claimed in claim 1, wherein said resin contained in said protective layer is selected from the group consisting of gelatin, starch, hydroxyethylcellulose, polyacrylic acid, carboxyethylcellulose, methoxycellulose, polyvinyl alcohol, and polyvinyl pyrrolidone.

8. The thermosensitive recording material as claimed in claim 1, further comprising an intermediate layer which is provided between said support and said thermosensitive coloring layer.

9. The thermosensitive recording material as claimed in claim 1, having a plurality of said protective layers overlaid on one another.

10. The thermosensitive recording material as claimed in claim 1, further comprising at least one additional protective layer comprising a resin and a filler laminated to said protective layer.

* * * * *